United States Patent [19]

Reed, Jr. et al.

[11] Patent Number: 5,061,330

[45] **Date of Patent: * Oct. 29, 1991**

[54] INSENSITIVE HIGH ENERGETIC EXPLOSIVE FORMULATIONS

[75] Inventors: Russell Reed, Jr.; May L. Chan, both of Ridgecrest, Calif.

[73] Assignee: The United States of America as represented by the Secretary of the Navy, Washington, D.C.

[ * ] Notice: The portion of the term of this patent subsequent to Apr. 12, 2000 has been disclaimed.

[21] Appl. No.: 440,678

[22] Filed: Nov. 1, 1982

[51] Int. Cl.[5] ..... C06B 45/10

[52] U.S. Cl. ..... 149/19.6; 149/19.4

[58] Field of Search ..... 149/19.4, 19.6, 19.1, 149/92

[56] References Cited

U.S. PATENT DOCUMENTS

| | | | |
|---|---|---|---|
| 3,907,907 | 9/1975 | Frankel et al. | 149/88 |
| 4,011,117 | 3/1977 | Lo et al. | 149/88 |
| 4,098,625 | 7/1978 | French et al. | 149/92 |
| 4,141,910 | 2/1979 | Flanagan et al. | 149/88 |
| 4,163,681 | 8/1979 | Rothenstein et al. | 149/92 |
| 4,168,191 | 9/1979 | Benziger | 149/92 |
| 4,269,637 | 5/1981 | Flanagan | 149/19.91 |
| 4,288,262 | 9/1981 | Flanagan et al. | 149/19.6 |
| 4,379,903 | 4/1983 | Reed et al. | 528/55 |

*Primary Examiner*—Edward A. Miller

*Attorney, Agent, or Firm*—Melvin J. Sliwka; Sol Sheinbein

[57] ABSTRACT

A cast cured propellant and explosive with a higher volume percentage of polymer resulting in improved mechanical and safety properties is made from glycidyl azide polymer, an energetic plasticizer and HMX or RDX. Aluminum powder can also be added.

4 Claims, No Drawings

INSENSITIVE HIGH ENERGETIC EXPLOSIVE FORMULATIONS

This is a continuation of application Ser. No. 07/241,189 filed Sept. 7, 1988, now U.S. Pat. No. 4,968,441.

BACKGROUND OF THE INVENTION

1. Field of the Invention

This invention relates to propellants and explosives. More particularly, this invention relates to cast cured propellants and explosives containing energetic polymeric binders.

2. Description of the Prior Art

Conventional plastic-bonded explosives (PBXs) contain inert polymers as desensitizing binders. One commonly used inert binder is polyethylene glycol. Pressed PBX compositions can have relatively low levels of polymer or wax. Cast-cured PBXs contain higher levels or rubbery polymers to improve the processing. High levels of polymer make these compositions less hazardous, but also less energetic.

Some studies have suggested that the hazard properties in detonable propellants and explosives become more benign as propellant toughness is increased. Propellant toughness is a combination of tensile strength and elongation properties. These properties are known to be improved by an increase in the percent volume of polymer in the composition.

A reduction in the amount of crystalline explosive filler such as cyclotetramethylene tetranitramine tetranitramine (HMX) and cyclotrimethylenetrinitramine (RDX) will improve the safety properties. Energetic plasticizers have been substituted for a portion of the solid fillers with varied success. Previously, the use of high levels of plasticizers has been associated with the problem of plasticizer exudation.

SUMMARY OF THE INVENTION

The present invention is a cast-cured propellant and explosive composition. The composition comprises glycidyl azide polymer as an energetic binder, a plasticizer selected from the group consisting of bis(2,2-dinitro-2-fluoroethyl) formal, a eutectic mixture of bis(2,2-dinitropropyl) formal/acetal, trimethylolethane trinitrate, triethyleneglycol dinitrate, and HMX. Additionally, aluminum can be added to the composition.

OBJECTS OF THE INVENTION

Accordingly, it is an object of this invention to provide a cast-cured propellant and explosive composition having a high content of polymeric binder and energetic plasticizer with a reduced HMX or RDX content.

Another object of this invention is to provide a cast-cured propellant and explosive using the energetic binder glycidyl azide polymer in place of the inert polymer binder.

Still another object of the invention is to provide a propellant and explosive with improved mechanical properties to give greater safety.

Yet another object of the invention is to provide a propellant and explosive having a high tensile strength and better elongation properties.

These and other objects of the invention will become apparent from the following specification.

DETAILED DESCRIPTION OF THE INVENTION

The energetic azido-polymer glycidyl azide polymer (GAP) is used as a binder in plastic-bonded explosive compositions. Basically, the energetic binder GAP comprises hydroxyterminated aliphatic polyether having pendent alkyl azide groups. The GAP energetic binder is more fully described in U.S. Pat. No. 4,268,450. PBXs with this binder have enhanced properties in the areas of performance and safety. Formulations with the relatively high content of the energetic polymer GAP significantly increase the volumetric fraction of polymers, but do not reduce performance. The level of crystalline explosive HMX or RDX is reduced as the energetic binder content is increased. This transfer of energy releasing groups from the solid phase to the soft polymeric binder phase results in a high performance propellant or explosive with reduced hazard potential.

A further enhancement of the safety properties of a cast-cured PBX is achieved by replacing additional HMX or RDX, the solid crystalline filler, with an energetic plasticizer. Improved safety results from reduced sensitivity to initiation by impact shock and deflagration to detonation transition during processing, transportation, and combat use. High levels of plasticizers previously caused problems having a tendency to suffer plasticizer exudation. Explosives and propellants have stringent requirements which allow no exudation during temperature cycling and the aging of plasticized compositions. The need for more energetic rocket propellants led to the development of various compositions containing high levels of energetic plasticizers which exhibit no exudation.

GAP has been found to retain high levels of plasticizers without exudation (plasticizer/polymer, Pl/Po=6.0). Earlier compositions with the inert binder polyethylene glycol contained up to only 3 parts plasticizer per 1 part polymeric binder. The plasticizers used with the GAP binder in these formulations include bis(2,2-dinitro-2-fluoroethyl) formal (FEFO), a eutectic mixture of bis(2,2-dinitropropyl) formal/acetal (BDNPF/A), trimethylolethane trinitrate (TMETN), and triethyleneglycol dinitrate. FEFO is the most desirable PBX plasticizer because of its high energy contribution and least loss of mechanical properties. BNDPF/A is lower in energy contribution but has favorable effects on PBX mechanical and hazard properties.

A number of 70 g propellant formulations were prepared under vacuum in high shear vertical mixers according to standard procedure known to those in the art. Triphenyl bismuth (0.02 wt percent) and dibutyltin dilaurate (0.005 wt. percent) were used as catalysts, while the biuret trimer of hexamethylene diisocyanate was used as the curative for these compositions. Curatives such as 4,4'-Diisocyanatodicyclohexylmethane or hexamethylene diisocyanate can be used to replace a portion of the biuret trimer. Both the ethylene glycol initiated GAP and the glycerol initiated GAP were used. The mechanical properties were best with the ethylene glycol initiated GAP. The characteristics of the ethylene glycol GAP which was made by Rocketdyne Division of Rockwell International were: $\overline{M}n$-1869, $\overline{M}w$ 2139, pd-1.14, eg. wt. 1122, $\Delta Hf$ cal/g 189, and density 1.3.

The following examples illustrate specific embodiments of the invention: Example I summarizes the formulations of GAP alone and with the various plasticizers.

EXAMPLE I

| Ingredient, % Wt | A | B | C | D |
|---|---|---|---|---|
| GAP | 16.26 | 16.26 | 16.26 | 30.7 |
| FEFO | 13.74 | — | — | — |
| TMETN | — | 13.74 | — | — |
| BDNPF/A | — | — | 13.74 | — |
| HMX (10 μm) | 60.0 | 60.0 | 60.0 | 56.25 |
| Al (18 μm) | 10.0 | 10.0 | 10.0 | 13.04 |
| Impact sensitivity (cm 2.5 Kg, 50%) | 28 | 31 | 36 | 48 |

EXAMPLE II

| Ingredient, % Wt | A | B | C | D |
|---|---|---|---|---|
| GAP | 6 | 16.26 | 21.72 | 11.28 |
| BDNPF/A | 24 | 13.74 | 18.32 | 19.43 |
| Al | 13 | 10 | — | 13.04 |
| HMX | 57 | 60 | 60 | 56.25 |
| Sensitivity | 29 | 36 | 39 | 22 |
| Impact (2.5 Kg, 50%) | | | | |
| Friction (ABL, 1000 lb) | 9/10 NF | — | NF | NF |
| Electrostatic (0.25 J) | 10/10 NF | — | — | 10/10 NF |
| Vacuum Thermal | — | — | — | 0.22 |
| Stability (100° C., 48 hrs, ml/g) | | | | |
| Elongation | | | | |
| (max. stress, %) | — | — | — | 41 |
| (rupture, %) | — | — | — | 124 |
| Stress (max, psi) | — | — | — | 40 |
| Modulus (PSI/PSI) | — | — | — | 265 |

A formulation made similar to composition A in Example II, only with polyethylene glycol (PEG) rather than GAP had plasticizer exudation. The formulation with GAP produced satisfactory results. Detonation pressures of various compositions containing GAP were calculated using the Kamlet method. The compositions contain varied amounts of the GAP binder and FEFO plasticizer to reduce the amount of HMX or RDX. The mechanical properties such as toughness are related to the volume percent of polymer. As toughness increases the hazard sensitivity properties are improved.

EXAMPLE III

| | Prior art comp | | | | | |
|---|---|---|---|---|---|---|
| | (1) | (2) | (3) | (4) | (5) | (6) |
| PEG | 6.4 | — | — | — | — | — |
| GAP | — | 25.0 | 12.6 | 11.0 | 7.0 | 10.0 |
| FEFO | 18.61 | — | 50.4 | 44.0 | 28.0 | 20.0 |
| HMX | — | 75.0 | 37.0 | — | 65.0 | 57.0 + 13.0 Al |
| RDX | 75.— | — | — | 45.0 | — | — |
| Polymer, vol % | 8.9 | 32.8 | 16.0 | 13.9 | 9.2 | 14.8 |
| det. press (Kj, Kbar) | 266 | 278 | 267 | 267 | 311 | 295 |

Obviously, many modification and variations of the present invention are possible in light of the above teachings. It is therefore to be understood, that within the scope of the appended claims, the invention may be practiced otherwise that specifically described.

What is claimed is:

1. An explosive composition comprising:
glycidyl azide polymer as an energetic binder;
bis(2,2-dinitro-2-fluoroethyl) formal as a plasticizer; and
an explosive compound selected from the group consisting of cyclotetramethylenetetranitramine and cyclotrimethylenetrinitramine.

2. An explosive composition according to claim 1 further comprising aluminum powder.

3. An explosive composition according to claim 1 comprising on a weight percent basis: 7.0 to 12.6 percent glycidyl azide polymer, 20.0 to 50.4 percent bis(2,2-dinitro-2-fluoroethyl) formal and 37 to 65 percent explosive compound.

4. An explosive composition according to claim 2 comprising on a weight percent basis: 10.0 percent glycidyl azide polymer, 20.0 percent bis(2,2-dinitro-2-fluoroethyl) formal, 57 percent explosive compound and 13 percent aluminum powder.

* * * * *